US009969588B2

(12) United States Patent
Noso et al.

(10) Patent No.: US 9,969,588 B2
(45) Date of Patent: May 15, 2018

(54) SHEET ALIGNMENT DEVICE AND IMAGE FORMING APPARATUS

(71) Applicant: KYOCERA Document Solutions Inc., Osaka-shi, Osaka (JP)

(72) Inventors: Terumitsu Noso, Osaka (JP); Takeshi Matsuo, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days. days.

(21) Appl. No.: 15/474,863

(22) Filed: Mar. 30, 2017

(65) Prior Publication Data

US 2017/0313538 A1 Nov. 2, 2017

(30) Foreign Application Priority Data

Apr. 27, 2016 (JP) ..... 2016-089881

(51) Int. Cl.
*B65H 31/00* (2006.01)
*B65H 29/14* (2006.01)
(Continued)

(52) U.S. Cl.
CPC ..... *B65H 29/145* (2013.01); *B65H 31/02* (2013.01); *B65H 31/3027* (2013.01); *B65H 31/36* (2013.01); *B65H 2301/4212* (2013.01); *B65H 2301/4213* (2013.01); *B65H 2403/72* (2013.01); *B65H 2403/942* (2013.01); *B65H 2404/1441* (2013.01); *B65H 2404/1521* (2013.01);
(Continued)

(58) Field of Classification Search
CPC ..... B65H 9/004; B65H 9/006; B65H 9/008; B65H 29/20; B65H 29/22; B65H 29/145; B65H 31/02; B65H 31/3027; B65H 31/34; B65H 2404/144; B65H 2404/1441; B65H 2801/27
See application file for complete search history.

(56) References Cited

U.S. PATENT DOCUMENTS

2011/0091260 A1* 4/2011 Azuma ..... B65H 31/3027 399/410
2011/0133392 A1* 6/2011 Kushida ..... B65H 31/3027 271/110
(Continued)

FOREIGN PATENT DOCUMENTS

JP 09056820 A 3/1997

*Primary Examiner* — Prasad V Gokhale
(74) *Attorney, Agent, or Firm* — Alleman Hall Creasman & Tuttle LLP

(57) ABSTRACT

A sheet alignment device includes a driven roller, a drive roller, a displacement driving device, an information acquisition portion, and a displacement control portion. The drive roller is configured to rotate in a first rotation direction and in contact with an upper surface of each of sheets conveyed onto a tilt tray, to feed the sheets toward a base end portion of the tilt tray. The drive roller is configured to rotate in a second rotation direction and in contact with an uppermost surface of the sheets, to discharge the sheets from the tilt tray. The displacement control portion is configured to, when the drive roller rotates in the first rotation direction, control a holding position of the drive roller in accordance with the number of the sheets on the tilt tray and thickness information of each of the sheets acquired by the information acquisition portion.

3 Claims, 4 Drawing Sheets

(51) Int. Cl.
*B65H 31/02* (2006.01)
*B65H 31/30* (2006.01)
*B65H 31/36* (2006.01)

(52) U.S. Cl.
CPC .... *B65H 2511/214* (2013.01); *B65H 2513/10* (2013.01); *B65H 2513/50* (2013.01); *B65H 2557/242* (2013.01); *B65H 2801/06* (2013.01); *B65H 2801/27* (2013.01)

(56) References Cited

U.S. PATENT DOCUMENTS

| | | | | |
|---|---|---|---|---|
| 2012/0205853 | A1* | 8/2012 | Nakamura | B65H 29/20 270/58.01 |
| 2014/0061993 | A1* | 3/2014 | Shimura | B65H 39/00 270/58.09 |
| 2015/0086298 | A1* | 3/2015 | Kubota | G03G 15/6544 412/16 |
| 2016/0355364 | A1* | 12/2016 | Shibata | B65H 31/02 |
| 2016/0376121 | A1* | 12/2016 | Komiyama | B65H 37/04 270/1.01 |

* cited by examiner

SHEET ALIGNMENT DEVICE AND IMAGE FORMING APPARATUS

INCORPORATION BY REFERENCE

This application is based upon and claims the benefit of priority from the corresponding Japanese Patent Application No. 2016-089881 filed on Apr. 27, 2016, the entire contents of which are incorporated herein by reference.

BACKGROUND

The present disclosure relates to a sheet alignment device and an image forming apparatus that includes the sheet alignment device.

An image forming apparatus may include a sheet alignment device that aligns a plurality of sheets on each of which image formation has been performed and discharges the sheets to a discharge tray.

Generally, the sheet alignment device includes a tilt tray, a sheet alignment portion, and a discharge roller pair. The sheet alignment portion rotates in contact with an upper surface of each of the sheets sequentially conveyed onto the tilt tray, to feed the sheets toward a base end portion of the tilt tray. Accordingly, rear ends of the respective sheets are aligned in contact with the base end portion. The discharge roller pair discharges the sheets stacked on the tilt tray to the discharge tray.

SUMMARY

A sheet alignment device according to one aspect of the present disclosure includes a tilt tray tilting from a base end portion to a head end portion present obliquely upward with respect to the base end portion. The sheet alignment device feeds each of sheets sequentially conveyed onto the tilt tray toward the base end portion of the tilt tray, to align the sheets, and discharges the sheets from the tilt tray to the head end portion side. The sheet alignment device includes a driven roller, a drive roller, a displacement driving device, an information acquisition portion, and a displacement control portion. The driven roller is rotatably supported and opposes, from below, a position on an extended line of the head end portion side of the tilt tray. The drive roller is rotatably supported above the driven roller. The drive roller is configured to rotate in a first rotation direction and in contact with an upper surface of each of the sheets conveyed onto the tilt tray to feed the sheets toward the base end portion of the tilt tray. Furthermore, the drive roller is configured to rotate in a second rotation direction and in contact with an uppermost surface of the sheets stacked on the tilt tray, to discharge the sheets from the tilt tray. The displacement driving device is configured to displace the drive roller, above the driven roller, between a reference position separated from each of the sheets and a position that contacts with each of the sheets. The information acquisition portion is configured to acquire thickness information indicating a thickness of each of the sheets conveyed onto the tilt tray. The displacement control portion is configured to, when the drive roller rotates in the first rotation direction, control the displacement driving device to control a holding position of the drive roller that contacts with each of the sheets in accordance with the number of the sheets on the tilt tray and the acquired thickness information. The information acquisition portion and the displacement control portion are realized by a processor.

An image forming apparatus according to another aspect of the present disclosure includes an image forming portion and the sheet alignment device. The image forming portion is configured to form an image on each of sheets. The sheet alignment device is configured to align the sheets sequentially conveyed from the image forming portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment of the present disclosure will be described based on the accompanying drawings. It should be noted that the following embodiment is an example embodying the present disclosure and does not limit the technical scope of the present disclosure.

[Configuration of Image Forming Apparatus 10]

Figure 1:
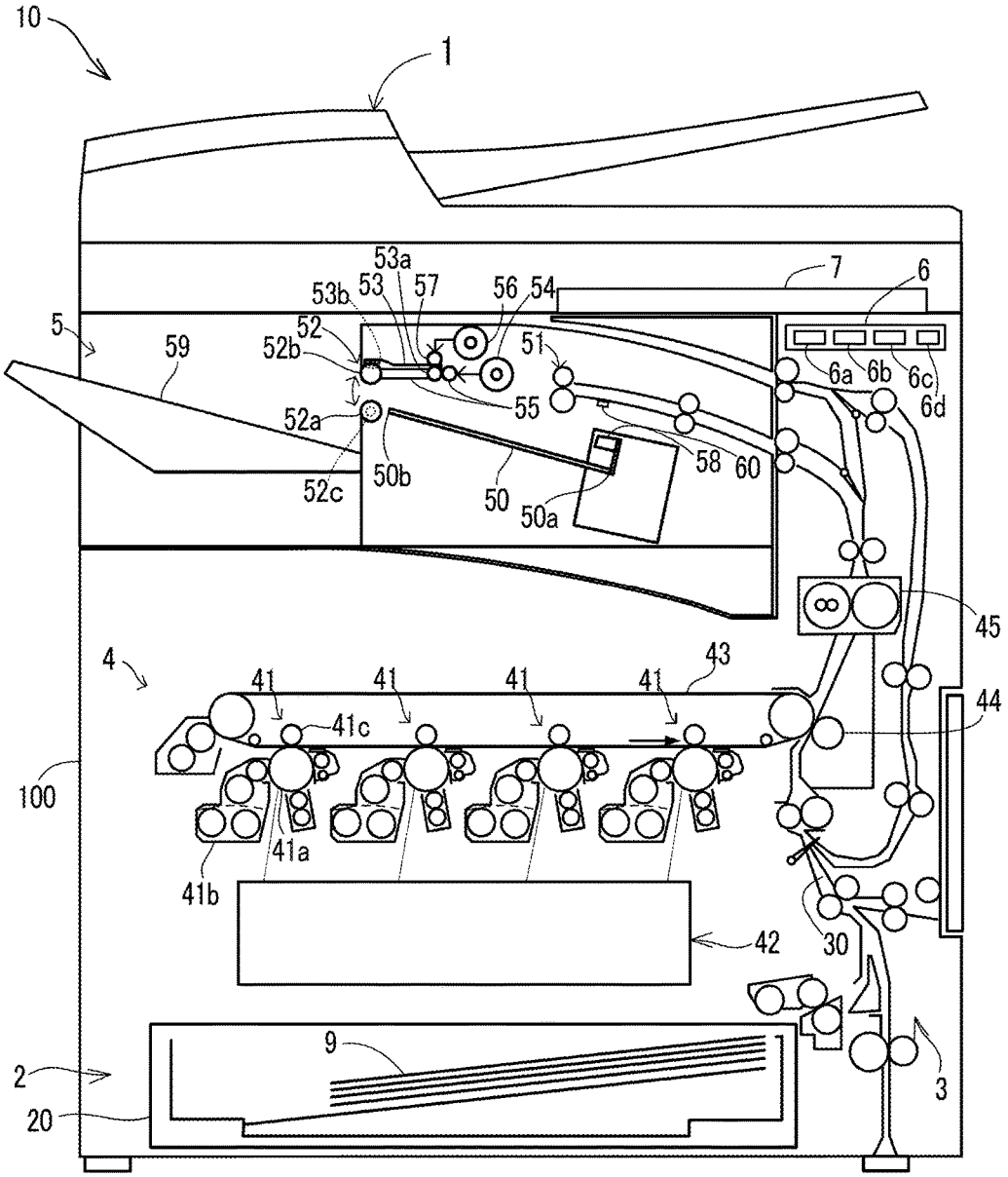
FIG. 1 is a configuration diagram of an image forming apparatus including a sheet alignment device according to an embodiment.

As shown in FIG. 1, a sheet alignment device 5 according to an embodiment forms a part of an image forming apparatus 10. The sheet alignment device 5 is incorporated between a body portion 100 that accommodates an image forming portion 4 and a scanner 1 disposed above the body portion 100.

The image forming apparatus 10 includes, in the body portion 100, a sheet feeding portion 2, a sheet conveying portion 3, the image forming portion 4, a control portion 6, and the like. The image forming apparatus 10 also includes an operation display portion 7 provided at a part of the scanner 1. The control portion 6 and the operation display portion 7 are also a part of the sheet alignment device 5. The image forming portion 4 forms an image on a sheet 9.

The image forming apparatus 10 shown in FIG. 1 is a tandem-type color image forming apparatus that forms an image of a toner on the sheet 9 by electrophotography.

Therefore, the image forming portion 4 includes a plurality of image preparation portions 41 provided for respective toner colors, a laser scanning unit 42, an intermediate transfer belt 43, a sheet transfer portion 44, and a fixing portion 45.

In each of the image preparation portions 41, an electrostatic latent image is formed by the laser scanning unit 42 on a surface of a photosensitive body 41*a*, a development portion 41*b* develops the electrostatic latent image into a toner image, and a belt transfer portion 41*c* transfers the toner image to an intermediate transfer belt 43.

The sheet feeding portion 2 feeds each of the sheets 9 stored in a sheet storage portion 20 to a sheet conveying path 30. The sheet transfer portion 44 transfers the toner image on the intermediate transfer belt 43 onto the sheet 9 conveyed by the sheet conveying portion 3. The fixing portion 45 heats the toner image to fix the toner image on the sheet 9.

The sheet alignment device 5 aligns the plurality of sheets 9 sequentially conveyed from the image forming portion 4 by the sheet conveying portion 3, and discharges the sheets 9 to a discharge tray 59 of the sheet alignment device 5.

Incidentally, the sheet alignment device 5 needs to be simplified and downsized. Especially as in the present embodiment, when the sheet alignment device 5 is disposed between the body portion 100 of the image forming apparatus 10 and the scanner 1 disposed above the body portion 100, the downsizing of the sheet alignment device 5 is important.

As described below, the sheet alignment device 5 includes a configuration capable of simplifying and downsizing a device.

[Configuration of Sheet Alignment Device 5]

Figure 2:
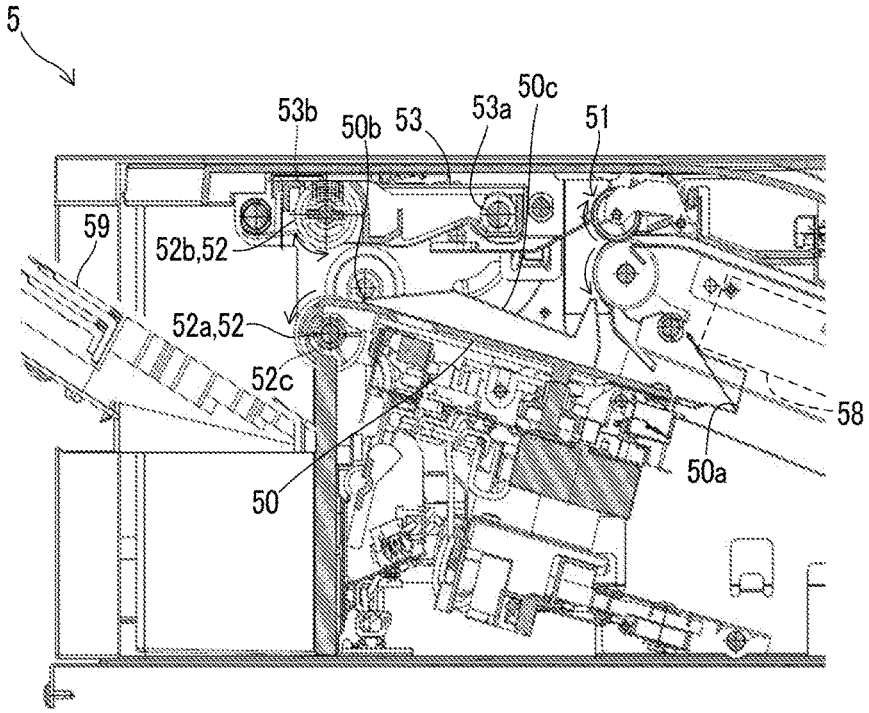
FIG. 2 is a cross-sectional view of a major part of the sheet alignment device according to the embodiment.

As shown in FIGS. 1 and 2, the sheet alignment device 5 includes a tilt tray 50, a carry-in roller pair 51, a discharge roller pair 52, a rotation support portion 53, a rotation drive motor 54, a rotation transmission mechanism 55, a displacement control motor 56, a displacement transmission mechanism 57, a stapler 58, the discharge tray 59, and the like.

The tilt tray 50 is a sheet receiving portion tilting from a base end portion 50*a* to a head end portion 50*b* present obliquely upward with respect to the base end portion 50*a*. The carry-in roller pair 51 is driven to rotate by an unshown motor, and conveys the sheets 9 conveyed from the image forming portion 4 to the tilt tray 50.

The sheet alignment device 5 feeds the plurality of sheets 9 sequentially conveyed by the carry-in roller pair 51 onto the tilt tray 50, toward the base end portion 50*a* of the tilt tray 50 to align the sheets 9, and discharges the sheets 9 from the tilt tray 50 to the discharge tray 59 on the head end portion 50*b* side.

The discharge roller pair 52 includes a driven roller 52*a* and a drive roller 52*b*. The driven roller 52*a* is rotatably supported and opposes, from below, a position on an extended line on the head end portion 50*b* side of the tilt tray 50.

The drive roller 52*b* is supported so as to be displaceable in an up-down direction by the rotation support portion 53 above the driven roller 52*a*. The rotation support portion 53 supports the drive roller 52*b* so as to be displaceable between a reference position separated from the driven roller 52*a* and a position adjacent to the driven roller 52*a*, above the driven roller 52*a*.

The rotation support portion 53 has a rotatably supported rotary shaft 53*a*, and the rotation support portion 53 rotates about the rotary shaft 53*a* by rotation of the rotary shaft 53*a*. Accordingly, the drive roller 52*b* is displaced between the reference position and the position adjacent to the driven roller 52*a*.

The reference position is a position separated from the sheet 9 conveyed onto the tilt tray 50. By being supported at the position adjacent to the driven roller 52*a* by the rotation support portion 53, the drive roller 52*b* comes into contact with an upper surface of the sheet 9 conveyed onto the tilt tray 50.

Figure 3:
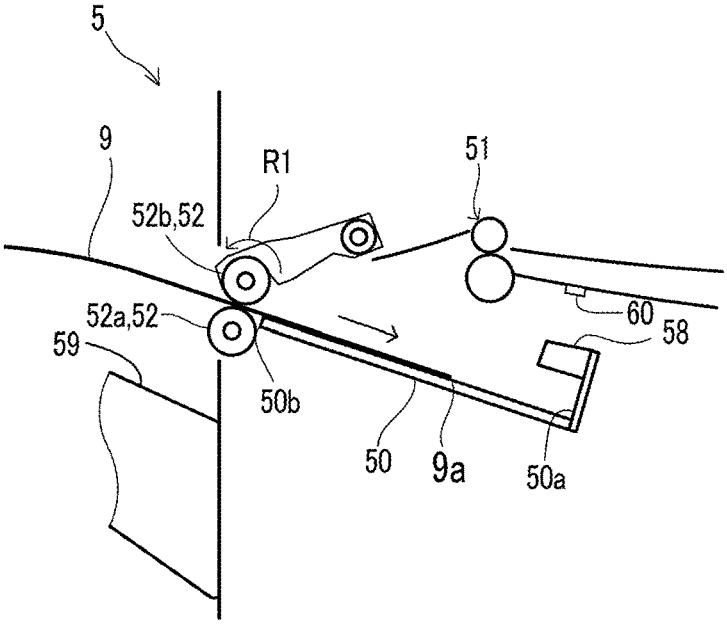
FIG. 3 is a diagram showing a state in which the sheet alignment device according to the embodiment is performing pull-in conveyance of the first sheet.
Figure 5:
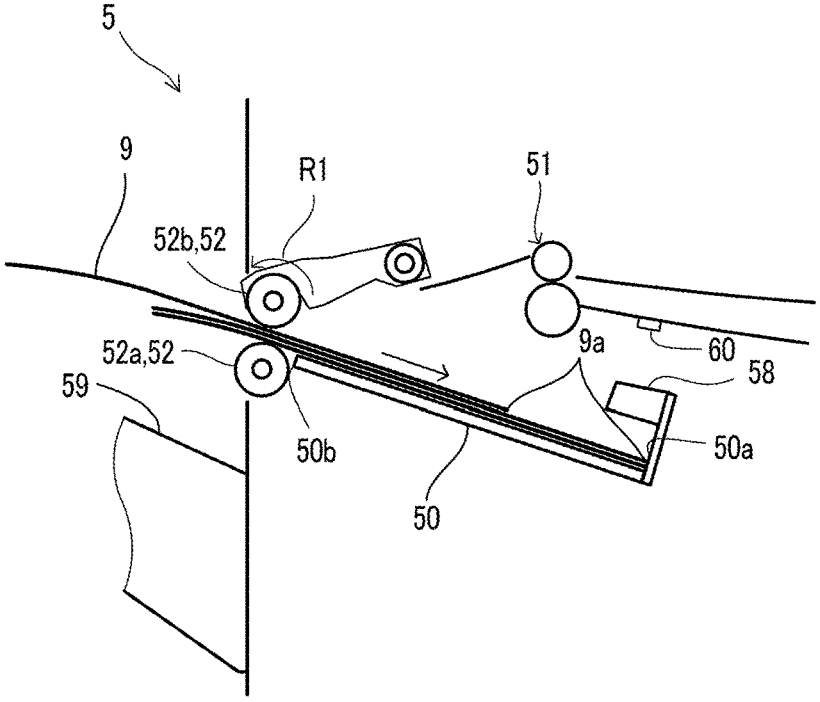
FIG. 5 is a diagram showing a state in which the sheet alignment device according to the embodiment is performing the pull-in conveyance of the second and following sheets.
Figure 6:
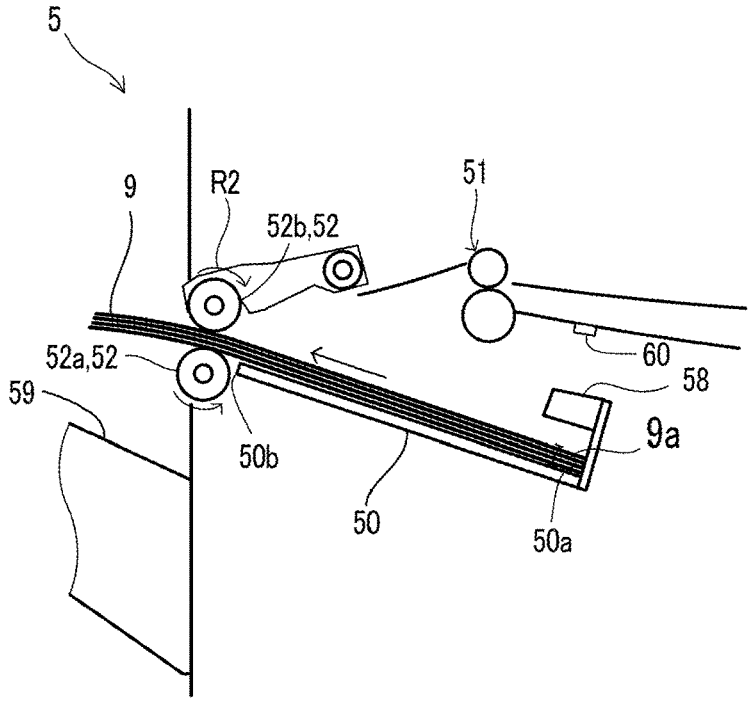
FIG. 6 is a diagram showing a state in which the sheet alignment device according to the embodiment is performing discharge conveyance of a plurality of sheets.

FIGS. 1 and 2 show the drive roller 52*b* supported at the reference position. FIGS. 3, 5, and 6 show the drive roller 52*b* supported at a position that contacts with the sheet 9 on the tilt tray 50.

The displacement control motor 56 is connected to the rotary shaft 53*a* of the rotation support portion 53 via the displacement transmission mechanism 57. The displacement control motor 56 is a servomotor capable of positioning in a rotation direction, and is a stepping motor, for example.

The displacement transmission mechanism 57 is a mechanism that transmits a rotational force of the displacement control motor 56 to the rotary shaft 53*a* of the rotation support portion 53, and includes a gear fixed to each of a shaft of the displacement control motor 56 and the rotary shaft 53*a* of the rotation support portion 53, and the like.

The displacement control motor 56 is an example of the displacement driving device that causes the drive roller 52*b* to be displaced between the reference position and the position that contacts with the sheet 9, above the driven roller 52*a*.

The drive roller 52*b* is energized in a direction toward the driven roller 52*a* by a spring 53*b* provided to the rotation support portion 53. The spring 53*b* is elastically deformed in accordance with pressure with which the sheet 9 is nipped between the driven roller 52*a* and the drive roller 52*b*. When the drive roller 52*b* is displaced to a position for nipping the sheet 9 between the drive roller 52*b* and the driven roller 52*a*, the spring 53*b* prevents excessive load from being applied to the displacement control motor 56.

The rotation drive motor 54 is connected to the drive roller 52*b* via the rotation transmission mechanism 55. The rotation drive motor 54 rotates the drive roller 52*b* in each of a first rotation direction R1 and a second rotation direction R2 in accordance with the situation (see FIGS. 3 and 6).

The rotation drive motor 54 is a motor that allows control of a rotation direction and a rotation speed. For example, the rotation drive motor 54 may be a stepping motor.

The rotation transmission mechanism 55 is a mechanism that transmits a rotational force of the rotation drive motor 54 to the drive roller 52*b*. For example, the rotation transmission mechanism 55 includes a relay rotating body rotatably supported with respect to the rotary shaft 53*a* of the rotation support portion 53, a belt that causes the relay rotating body and a rotation shaft of the drive roller 52*b* to be interlocked with each other, and a gear fixed to each of the relay rotating body and a rotation shaft of the rotation drive motor 54.

As shown in FIGS. 3 and 5, the drive roller 52*b* rotates in the first rotation direction R1 and in contact with the upper surface of each of the sheets 9 conveyed onto the tilt tray 50, to feed the sheets 9 toward the base end portion 50*a* of the tilt tray 50. In the following description, conveying the sheet 9 by the drive roller 52*b* rotating in the first rotation direction R1 is referred to as pull-in conveyance.

By the drive roller 52*b* performing the pull-in conveyance, a rear end 9*a* of each of the sheets 9 sequentially conveyed onto the tilt tray 50 contacts with the base end portion 50*a* of the tilt tray 50. As a result, the plurality of sheets 9 are stacked on the tilt tray 50 while being aligned with each other on the basis of the base end portion 50*a* of the tilt tray 50.

As shown in FIG. 6, the drive roller 52*b* rotates in the second rotation direction R2 and in contact with the uppermost surface of the plurality of sheets 9 stacked on the tilt tray 50, to discharge the sheets 9 from the tilt tray 50 to the discharge tray 59. In the following description, conveying the sheet 9 by the drive roller 52*b* rotating in the second rotation direction R2 is referred to as discharge conveyance. The sheet alignment device 5 also includes a shift mechanism 50*c* that moves the tilt tray 50 and the sheets 9 on the tilt tray 50 along a width direction of the sheet 9 (see FIG. 2).

In the discharge conveyance, the drive roller 52*b* rotates in the second rotation direction R2 while nipping the plurality of sheets 9 between the drive roller 52*b* and the driven roller 52*a*, and the driven roller 52*a* rotates so as to follow rotation of the drive roller 52*b*.

A rotation shaft of the driven roller 52*a* is provided with a one-way clutch 52*c* that allows rotation only in the direction of rotation that follows the rotation of the drive roller 52*b* in the second rotation direction R2. That is, the driven roller 52*a* is supported so as to be rotatable only in the direction of rotation that follows the rotation of the drive roller 52*b* in the second rotation direction R2.

Therefore, as shown in FIGS. 3 and 5, when the drive roller 52*b* performs the pull-in conveyance, the driven roller 52*a* does not rotate. Accordingly, as shown in FIG. 5, the second and following sheets 9 are newly conveyed onto the sheet 9 on the tilt tray 50, the newly conveyed sheet 9 is only subject to the pull-in conveyance.

As shown in FIG. 3, when the first sheet 9 is subject to the pull-in conveyance, even if the driven roller 52*a* rotates so as to follow the rotation of the drive roller 52*b*, no particular problem occurs.

However, as shown in FIG. 5, when the second and following sheets 9 are subject to the pull-in conveyance, if the driven roller 52*a* rotates so as to follow the rotation of the drive roller 52*b*, the newly conveyed sheets 9 and all the other sheets 9 already aligned on the tilt tray 50 receive a force from the drive roller 52*b* and the driven roller 52*a* toward the base end portion 50*a* side of the tilt tray 50. In this case, the aligned sheets 9 may be bent. The one-way clutch 52*c* is provided to prevent such bending of the sheets 9.

The stapler 58 performs a stapling process on a part adjacent to the rear end 9*a* of the sheets 9 aligned on the tilt tray 50.

The control portion 6 controls electric devices included in the image forming apparatus 10 that includes the sheet alignment device 5. The control portion 6 includes a rotation control portion 6*a* that controls the rotation drive motor 54 and a displacement control portion 6*b* that controls the displacement control motor 56. For example, the control portion 6 is realized by a processor such as MPU (Micro Processing Unit).

The operation display portion 7 is a user interface that includes an operation portion receiving a user information input operation and a display portion displaying various types of information. For example, the operation portion includes operation buttons, a touch panel, and the like. The display portion is a panel display portion such as a liquid crystal display panel.

The control portion 6 further includes an information acquisition portion 6*c* that acquires the thickness information indicating a thickness of the sheet 9 stored in the sheet storage portion 20, in accordance with an operation on the operation portion of the operation display portion 7. For example, the thickness information is sheet type information capable of specifying the thickness of the sheet 9, such as thin paper, thick paper, or a postcard, numerical information indicating the thickness of the sheet 9 at a plurality of stages, or the like.

The information acquisition portion 6*c* causes a non-transitory computer-readable data storage portion 6*d* to store the acquired thickness information. The data storage portion 6*d* is a nonvolatile memory. When the thickness information is the sheet type information, information indicating a correspondence relationship between the sheet type information and a value indicating the thickness of the sheet 9 is stored in the data storage portion 6*d* in advance.

For example, the thickness information is used to control a fixing temperature that is a temperature for heating the toner image by the fixing portion 45. As the thickness of the sheet 9 increases, the fixing temperature is set at a higher temperature.

When the image forming apparatus 10 includes the plurality of sheet storage portions 20, the information acquisition portion 6*c* acquires the thickness information of each of the sheet storage portions 20 and causes the data storage portion 6*d* to store the information.

The thickness information stored in the data storage portion 6*d* is also information indicating the thickness of the sheet 9 conveyed from the image forming portion 4 to the tilt tray 50 of the sheet alignment device 5.

Every time the sheet 9 is conveyed onto the tilt tray 50 by the carry-in roller pair 51, the displacement control portion 6*b* controls the displacement control motor 56 to displace the drive roller 52*b* from the reference position to a sheet nip position that contacts with the upper surface of the sheet 9. At this time, the drive roller 52*b* is stopping rotation.

By the drive roller 52*b* being displaced from the reference position to the sheet nip position while stopping rotation, the sheet 9 fed out from the carry-in roller pair 51 stops on the tilt tray 50. As a result, it is possible to prevent the sheet 9 fed out from the carry-in roller pair 51 from straightly passing by the tilt tray 50.

For example, the sheet alignment device 5 may include a sheet detection sensor 60 provided on an upstream side in a conveying direction of the sheet 9 with respect to the carry-in roller pair 51 in a conveying path of the sheet 9. In this case, when a predetermined time elapses from a time point at which the sheet detection sensor 60 has changed from a state of detecting the sheet 9 to a state of not detecting the sheet 9 during operation of the carry-in roller pair 51, the displacement control portion 6*b* causes the drive roller 52*b* to be displaced from the reference position to the sheet nip position.

The displacement control portion 6*b* counts up a preset counter variable every time the sheet 9 is conveyed onto the tilt tray 50 by the carry-in roller pair 51, to count the number of the sheets 9 on the tilt tray 50.

When the sheet 9 on the tilt tray 50 has been discharged to the discharge tray 59 by the discharge conveyance, the displacement control portion 6*b* initializes the counter variable.

The sheet alignment device 5 performs the pull-in conveyance, every time the sheet 9 is conveyed onto the tilt tray 50 by the carry-in roller pair 51.

The displacement control portion 6*b* controls the displacement control motor 56 when the pull-in conveyance is performed, to control a holding position of the drive roller 52*b* that contacts with the sheet 9 in accordance with the number of the sheets 9 on the tilt tray 50 and the thickness information acquired by the information acquisition portion 6*c*. In the following description, the holding position is referred to as a sheet pull-in position.

More specifically, the displacement control portion 6*b* sets the sheet pull-in position such that an interval between the driven roller 52*a* and the drive roller 52*b* is proportional to the number of the sheets 9 on the tilt tray 50 and the thickness of the sheet 9 indicated by the thickness information.

That is, the displacement control portion 6*b* controls a displacement amount of the drive roller 52*b* from the reference position to the sheet pull-in position such that as the number of the sheets 9 on the tilt tray 50 increases, the displacement amount decreases, and as the thickness of the sheet 9 indicated by the thickness information increases, the displacement amount decreases. For example, the sheet nip position may be the same as the sheet pull-in position.

While the displacement control portion 6*b* holds the drive roller 52*b* at the sheet pull-in position, the rotation control portion 6*a* causes the drive roller 52*b* to rotate in the first rotation direction R1. Accordingly, the drive roller 52*b* rotates in the first rotation direction R1 and in contact with the uppermost sheet 9, and the pull-in conveyance is performed.

The sheet nip position may be at a position closer to the driven roller 52*a* than the sheet pull-in position is. In this case, the displacement control portion 6*b* displaces the drive roller 52*b* that is stopping rotation from the reference position to the sheet nip position, and thereafter, displaces the driver roller 52*b* to the sheet pull-in position closer to the reference position than the sheet nip position is.

The rotation control portion 6*a* rotates the drive roller 52*b* at a constant speed in the first rotation direction R1, until a preset steady conveyance period elapses from a start of the pull-in conveyance. Hereinafter, this constant rotation speed is referred to as a steady rotation speed V01 (see FIG. 7).

Figure 7:
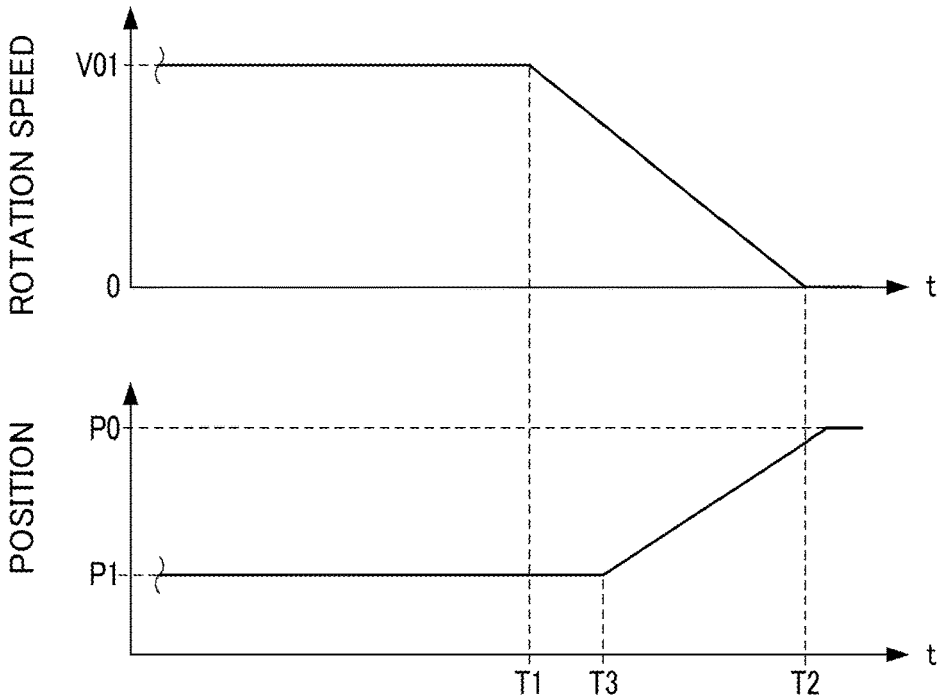
FIG. 7 is a trend graph showing a rotation speed and a position change of a discharge drive roller when the sheet alignment device according to the embodiment finishes the pull-in conveyance of the sheets.

In FIG. 7, P0 represents the reference position, and P1 represents the sheet pull-in position.

The steady conveyance time is time that elapses before the rear end 9*a* of the sheet 9 reaches the base end portion 50*a* of the tilt tray 50.

As shown in FIG. 7, the rotation control portion 6*a* starts deceleration of the rotation speed of the drive roller 52*b* from a time point T1 at which the steady conveyance time has elapsed. The rotation control portion 6*a* decelerates the rotation speed of the drive roller 52*b* at a preset pace until the drive roller 52*b* has stopped rotation. In FIG. 7, a time point T2 is a time point at which the drive roller 52*b* has stopped rotation.

In addition, while the pull-in conveyance is performed, the displacement control portion 6*b* displaces the drive roller 52*b* from the sheet pull-in position P1 that contacts with the sheet 9 to the reference position P0 at a time point T3 which is after the drive roller 52*b* starts deceleration from the steady rotation speed V01 and before the drive roller 52*b* stops rotation. Accordingly, the drive roller 52*b* separates from the sheet 9, and the pull-in conveyance by the drive roller 52*b* ends.

Figure 4:
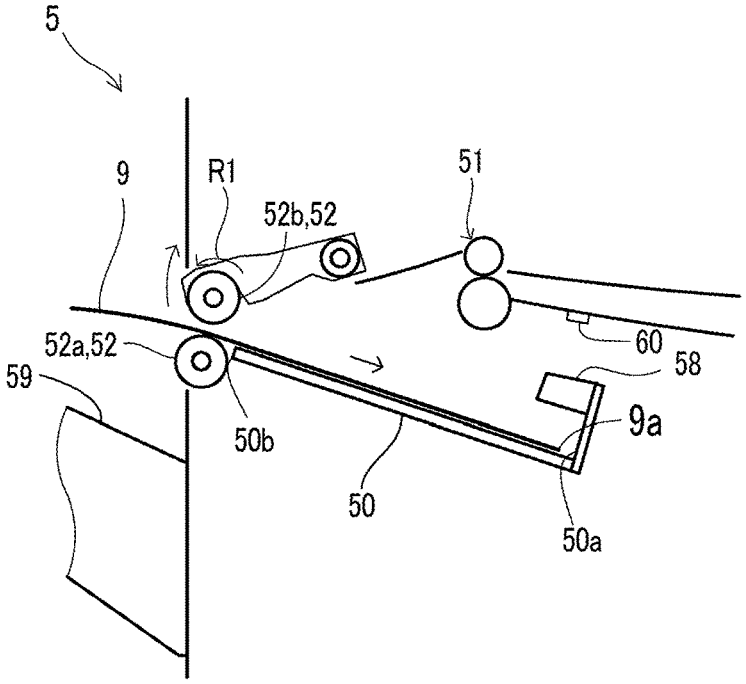
FIG. 4 is a diagram showing a state immediately after the sheet alignment device according to the embodiment has finished the pull-in conveyance of the sheet.

FIG. 4 shows a state of the sheet alignment device 5 immediately after the time point T3 in FIG. 7. As shown in FIG. 4, the time point T3 at which the displacement control portion 6*b* causes the drive roller 52*b* to be displaced from the sheet pull-in position P1 toward the reference position P0 is a time point shortly before the rear end 9*a* of the sheet 9 reaches the base end portion 50*a* of the tilt tray 50.

After the drive roller 52*b* has separated from the sheet 9, the rear end 9*a* of the sheet 9 moves to a position that contacts with the base end portion 50*a* of the tilt tray 50, due to inertia of the pull-in conveyance that has been performed so far.

In the present embodiment, the steady rotation speed V01 that is relatively rapid is set to ensure high-speed processing of aligning the plurality of sheets 9. However, when the drive roller 52*b* separates from the sheet 9 while rotating at a high speed, the sheet 9 may vigorously collide with the base end portion 50*a* of the tilt tray 50, and may rebound largely.

In the sheet alignment device 5, at a time point at which the rear end 9*a* of the sheet 9 has approached the base end portion 50*a* of the tilt tray 50, the rotation speed of the drive roller 52*b* decelerates to an appropriate speed, and the drive roller 52*b* separates from the sheet 9. Accordingly, it is possible to prevent the sheet 9 from largely rebounding from the base end portion 50*a* of the tilt tray 50. As a result, the sheet alignment device 5 is capable of realizing both high speed and high accuracy of the process of aligning the sheets 9.

As described above, the rotation control portion 6*a* and the displacement control portion 6*b* perform control of the pull-in conveyance of the sheet, every time the sheet 9 is fed onto the tilt tray 50.

The stapler 58 performs the stapling process on the plurality of sheets 9 aligned on the tilt tray 50, every time the number of the sheets 9 on the tilt tray 50 reaches a preset alignment number of sheets. The rotation control portion 6*a* and the displacement control portion 6*b* cause the drive roller 52*b* to perform sheet discharge conveyance.

In the sheet discharge conveyance, before the next sheet 9 is conveyed onto the tilt tray 50 after the pull-in conveyance has finished, the displacement control portion 6*b* controls the displacement control motor 56 to displace the drive roller 52*b* to the sheet nip position again. The rotation control portion 6*a* causes the drive roller 52*b* held at the sheet nip position to rotate in the second rotation direction R2.

The sheet discharge conveyance may be performed without the stapling process being performed. For example, the shift mechanism 50*c* as shown in FIG. 2 may perform a process of sorting by moving the tilt tray 50 to a first side end in a width direction of the sheet 9 or a second side end opposing the first side end, every time the number of the sheets 9 on the tilt tray 50 has reached the alignment number of sheets.

In the sorting process, the shift mechanism 50*c* alternately moves the tilt tray 50 to the first side end and the second side end of the sheet 9, every time the number of the sheets 9 on the tilt tray 50 has reached the alignment sheet number. Accordingly, the plurality of sheets 9 are discharged onto the discharge tray 59 while the positions of the sheets 9 are displaced from each other for every alignment number of sheets.

When the sheet alignment device 5 is employed, the discharge roller pair 52 that discharges the sheet 9 to the discharge tray 59 also serves as a rotating body to align the rear ends 9*a* of the sheets 9 at the base end portion 50*a* of the tilt tray 50. That is, in the sheet alignment device 5, it is not necessary to provide a dedicated rotating body to align the rear ends 9*a* of the sheets 9 at the base end portion 50*a* of the tilt tray 50.

Therefore, when the sheet alignment device 5 is employed, it is possible to simplify and downsize the device. The sheet alignment device 5 is especially preferred when disposed at a small space between the scanner 1 and the body portion 100 of the image forming apparatus 10.

The displacement control portion 6*b* controls the sheet pull-in position P1 of the drive roller 52*b* in accordance with the thickness information and the number of the sheets 9 on the tilt tray 50. Accordingly, in the pull-in conveyance, it is possible to prevent a problem in which since pressure of the drive roller 52*b* in contact with the sheet 9 is excessively strong, the plurality of sheets 9 including the aligned sheet 9 are conveyed to the base end portion 50*a* side of the tilt tray 50, resulting in that the aligned sheet 9 is bent. It is also possible to prevent the drive roller 52*b* from idling in the first rotation direction R1 at a position not in contact with the sheet 9.

APPLICATION EXAMPLE

The sheet alignment device 5 may not include the one-way clutch 52*c*. For example, in a direction in which the driven roller 52*a* rotates so as to follow the rotation of the drive roller 52*b* in the first rotation direction R1, the driven roller 52*a* may be rotatably supported with frictional resistance greater than that in a direction of rotating so as to follow the rotation of the drive roller 52*b* in the second rotation direction R2.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet alignment device that includes a tilt tray tilting from a base end portion to a head end portion present obliquely upward with respect to the base end portion, feeds each of sheets sequentially conveyed onto the tilt tray toward the base end portion of the tilt tray, to align the sheets, and discharges the sheets from the tilt tray to the head end portion side, the sheet alignment device comprising:

a driven roller rotatably supported and opposing, from below, a position on an extended line on the head end portion side of the tilt tray;

a drive roller rotatably supported above the driven roller, and configured to rotate in a first rotation direction and in contact with an upper surface of each of the sheets conveyed onto the tilt tray to feed the sheets toward the base end portion of the tilt tray, and rotate in a second rotation direction and in contact with an uppermost surface of the sheets stacked on the tilt tray, to discharge the sheets from the tilt tray;

a displacement driving device configured to displace the drive roller, above the driven roller, between a reference position separated from each of the sheets and a position that contacts with each of the sheets;

an information acquisition portion configured to acquire thickness information indicating a thickness of each of the sheets conveyed onto the tilt tray; and a displacement control portion configured to acquire a number of sheets on the tilt tray increased every time one of the sheets is conveyed onto the tilt tray, and, when the drive roller rotates in the first rotation direction, control the displacement driving device to control a holding position of the drive roller that contacts with each of the sheets in accordance with the number of the sheets on the tilt tray and the acquired thickness information, wherein the information acquisition portion and the displacement control portion are realized by a processor, and the driven roller is supported so as to be rotatable only in a direction of rotating so as to follow rotation of the drive roller in the second rotation direction.

2. The sheet alignment device according to claim 1, wherein when the drive roller rotates in the first rotation direction and in contact with each of the sheets, the displacement control portion displaces the drive roller from a position that contacts with each of the sheets toward the reference position before the drive roller stops after starting deceleration from a steady rotation speed.

3. An image forming apparatus comprising:

an image forming portion configured to form an image on each of sheets; and the sheet alignment device according to claim 1, configured to align the sheets sequentially conveyed from the image forming portion.

* * * * *